US008472635B2

(12) United States Patent
Tran

(10) Patent No.: US 8,472,635 B2
(45) Date of Patent: Jun. 25, 2013

(54) SYSTEM AND METHOD FOR COUNTERING NOISE WHEN OPERATING AN ADDRESS SYSTEM IN A PASSENGER TRANSPORT

(75) Inventor: George Van Tran, Bothell, WA (US)

(73) Assignee: The Boeing Company, Chicago, IL (US)

( * ) Notice: Subject to any disclaimer, the term of this patent is extended or adjusted under 35 U.S.C. 154(b) by 907 days.

(21) Appl. No.: 12/114,142

(22) Filed: May 2, 2008

(65) Prior Publication Data

US 2009/0274316 A1 Nov. 5, 2009

(51) Int. Cl.
*G10K 11/178* (2006.01)

(52) U.S. Cl.
USPC ..... 381/71.4

(58) Field of Classification Search
USPC ..... 381/71.4, 71.9; 181/206
See application file for complete search history.

(56) References Cited

U.S. PATENT DOCUMENTS 5,690,321 A * 11/1997 Seni et al. ..... 267/140.14
6,002,778 A * 12/1999 Rossetti et al. ..... 381/71.4
6,343,127 B1 * 1/2002 Billoud ..... 381/71.4
6,728,380 B1 * 4/2004 Zhu et al. ..... 381/71.4
7,099,822 B2 * 8/2006 Zangi ..... 704/226
2001/0031052 A1 * 10/2001 Lock et al. ..... 381/71.7
2002/0039422 A1 * 4/2002 Daly ..... 381/71.4
2002/0136415 A1 * 9/2002 Daly ..... 381/71.4
2004/0086135 A1 * 5/2004 Vaishya ..... 381/71.4
2005/0238179 A1 * 10/2005 Erdmann ..... 381/71.4
2005/0259830 A1 * 11/2005 Vaishya ..... 381/71.4
2007/0189549 A1 * 8/2007 Scheel et al. ..... 381/86

OTHER PUBLICATIONS

"Design of Active Noise Control Systems With the TMS320 Family"; Application Report by Texas Instruments; Jun. 1996.
"Active Noise Cancellation (ANC)—Block Diagrams, Reference Designs and Recommended Products"; Texas Instruments; May 1, 2008; http://focus.ti.com/docs/solution/folders.

* cited by examiner

*Primary Examiner* — Jeremy Luks
(74) *Attorney, Agent, or Firm* — Armstrong Teasdale, LLP

(57) ABSTRACT

A system for countering ambient noise when operating an address system in at least one compartment of a passenger transport unit includes: (a) a noise control unit; and (b) at least one memory unit coupled with the noise control unit. The at least one memory unit stores noise characteristic information relating with at least one operational condition of the transport unit. The noise control unit employs the noise characteristic information to effect the countering.

14 Claims, 4 Drawing Sheets

SYSTEM AND METHOD FOR COUNTERING NOISE WHEN OPERATING AN ADDRESS SYSTEM IN A PASSENGER TRANSPORT

FIELD

The present disclosure is directed to noise countering systems and methods, and especially to noise countering systems and methods for use with passenger transport units such as, by way of example and not by way of limitation, a passenger aircraft.

BACKGROUND

The following description may relate to a passenger aircraft, but the disclosure may be applicable to other passenger transport units with equal success. Noise levels in a passenger transport unit such as, by way of example and not by way of limitation, a passenger aircraft may vary significantly depending upon the operation in which the passenger transport is engaged. For example, an aircraft may present different levels of noise in a passenger compartment when the aircraft is engaged in an activity on the ground such as, by way of example and not by way of limitation, taxiing, taking off or landing.

Noise levels in a passenger aircraft may vary significantly when the aircraft is engaged in different activities aloft. By way of example and not by way of limitation, noise levels in a passenger compartment may vary when the aircraft is engaged in an activity aloft such as, by way of example and not by way of limitation, climbing, descending, turning or flying level.

Today's passenger transport units, such as passenger airplanes, may include a plurality of passenger compartments, and different passenger compartments may exhibit different noise characteristics during a given flight or ground evolution. By way of further example and not by way of limitation, a lower level passenger compartment may experience a greater noise level during ground taxiing than may be experienced in a compartment further removed from the ground.

Manual control of volume of an address system to accommodate various noise levels while using the address system may be difficult. Delivery of information via voice may actually be impaired by a user inexpertly adjusting output volume of the address system to counter noise while passengers are addressed.

There is a need for a system and method for countering noise when operating an address system in a passenger transport.

SUMMARY OF THE INVENTION

A system for countering ambient noise when operating an address system in at least one compartment of a passenger transport unit includes: (a) a noise control unit; and (b) at least one memory unit coupled with the noise control unit. The at least one memory unit stores noise characteristic information relating with at least one operational condition of the transport unit. The noise control unit employs the noise characteristic information to effect the countering.

The at least one memory unit may be at least one non-volatile memory unit. The at least one memory unit may store at least one noise profile data base containing information relating to operation of the passenger transport unit such as, by way of example and not by way of limitation, airplane compartment noise levels during different modes of operation. Modes of operation may include, by way of example and not by way of limitation, altitude expressed in feet, airspeed expressed as a Mach number, a WOW (Weight on Wheels) indicator relating to whether the passenger transport unit is on ground or aloft, door status indicating open or closed, at least one engine parameter such as RPM or thrust, flap position (up/down or position expressed in degrees), spoiler positions, wind speed (expressed in Miles Per Hour—MPH), ECS (Environmental Control System) status (indicating engagement of air conditioning or heat), APU (Auxiliary Power Unit) parameter (indicating Revolutions Per Minute—RPM), noise frequencies expressed in Hertz (Hz) and noise level expressed in Decibels (Db). Such noise profile data may be collected during flight tests, analyzed and then refined to fit flight patterns of respective aircraft models.

An audio processor may employ the noise profile data base to define ambient noise parameters for each flight mode of an aircraft. At least one communication bus with a backbone communication bus may be employed to obtain information for storing in the noise profile data base, such as noise profile data listed above.

A method for countering ambient noise when operating an address system in at least one compartment of a passenger transport unit includes: (a) in no particular order: (1) providing a noise control unit; and (2) providing at least one memory unit; (b) coupling the at least one memory unit with the noise control unit; (c) operating the at least one memory unit to store noise characteristic information relating with at least one operational condition of the transport unit; and (d) operating the noise control unit employing the noise characteristic information to effect countering.

It is, therefore, a feature of the present disclosure to present a system and method for countering noise when operating an address system in a passenger transport.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION

Figure 1:
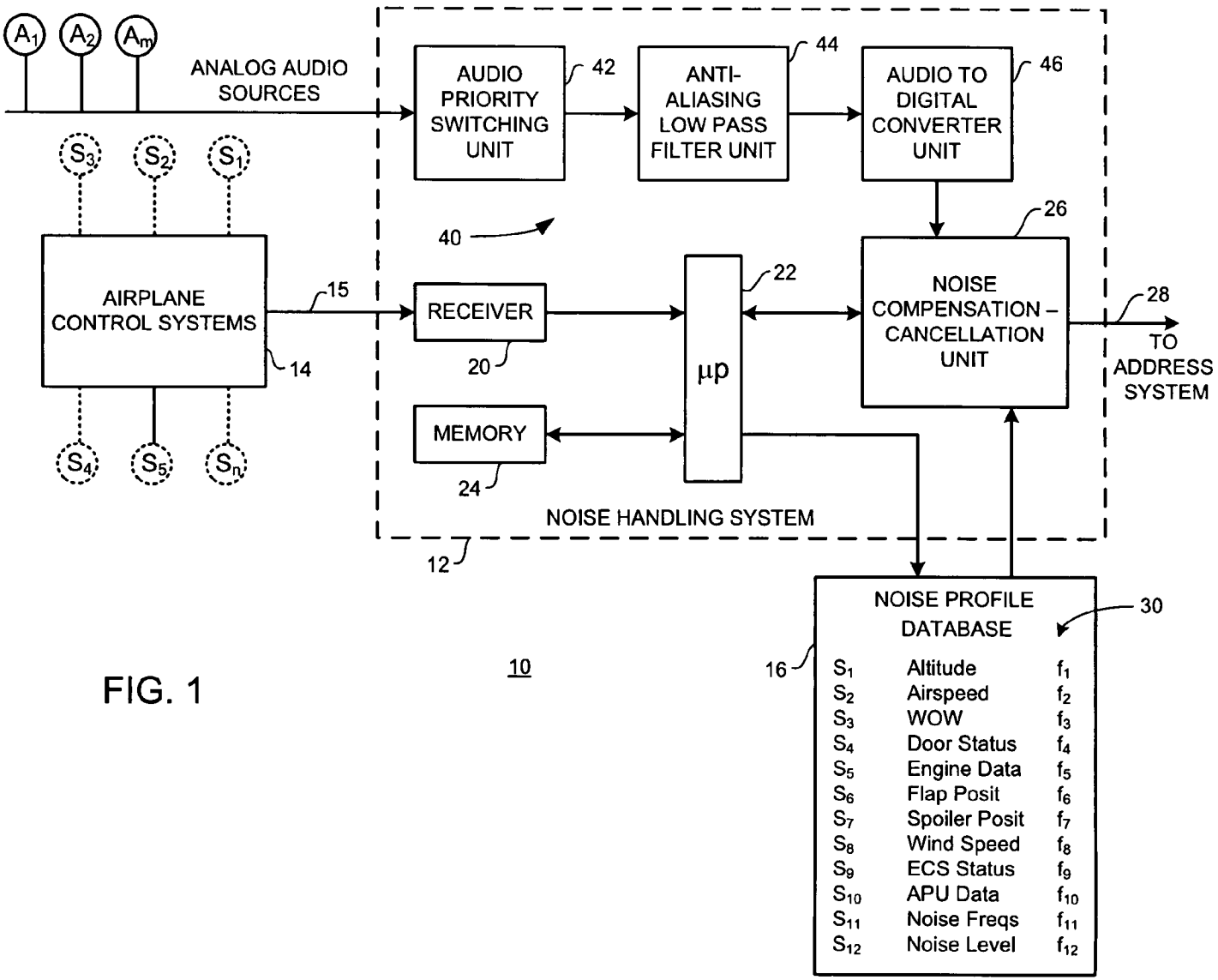
FIG. 1 is a schematic illustration of a system for countering ambient noise when operating an address system in a compartment of passenger transport unit.

FIG. 1 is a schematic illustration of a system for countering ambient noise when operating an address system in a compartment of passenger transport unit. In FIG. 1, a system 10 for countering noise in a compartment of a passenger transport unit may include a noise handling system 12. Noise handling system 12 may be coupled with a transport control unit such as an airplane control unit 14 via an aircraft communication bus 15 or similar communicating connection.

Airplane control unit 14 may be coupled with a plurality of sensors located in various loci about an airplane for presenting an indication representing operation condition of a transportation unit carrying system 10, such as an airplane. Airplane control unit 14 may be coupled with sensors $S_1$, $S_2$, $S_3$, $S_4$, $S_5$, $S_n$. These sensors may be used for the Flight Controls System. The indicator "n" is employed to signify that there can be any number of sensors coupled with airplane control unit 14. The inclusion of six sensors $S_1$, $S_2$, $S_3$, $S_4$, $S_5$, $S_n$ in FIG. 1 is illustrative only and does not constitute any limitation regarding the number of sensors that may be included in the system of the present disclosure.

Sensors $S_1$, $S_2$, $S_3$, $S_4$, $S_5$, $S_n$ may be used by airplane control unit 14 for other purposes, and may include by way of example and not by way of limitation, the following indicators:

Altitude (Feet)
Airspeed (Mach)
WOW (Weight on Wheels; indicates whether airplane is on ground or aloft)
Door Status (Open or Closed)
Engine Parameter(s) (RPM or Thrust)
Flap Position (Up or Down; Degrees)
Spoiler Positions
Wind Speed (MPH)
ECS Status (Environmental Control System; AC or Heat)
APU Parameter(s) (Auxiliary Power Unit; RPM)
Noise Frequencies (Hz)
Noise Level (dB)

Each of the sensors may provide information or indications that may be represented in terms of the contribution the sensed indication may make to ambient noise within a compartment of a transport unit, such as an airplane. By way of example and not by way of limitation, different evolutions may present different noise characteristics in a compartment of an aircraft. An airplane may present a first set of noises—in terms of volume levels, frequencies and patterns—while taxiing to a runway in preparation for take off. The same aircraft may present a different second set of noises while taking off. The same aircraft may present a third set of noises while cruising. Characteristics of noises sensed by sensors $S_1$, $S_2$, $S_3$, $S_4$, $S_5$, $S_n$ may be stored in a memory or storage unit 16. Noise handling system 12 may include a receiver unit 20 coupled with a processing unit, such as by way of example and not by way of limitation, microprocessor unit 22. Microprocessor unit 22 may be coupled with a local memory unit 24 to aid in processing performed by microprocessor unit 22. Memory unit 16 may be coupled with microprocessor unit 22. Memory unit 16 may be coupled with airplane control unit 14 for receiving updates of indications from sensors $S_1$, $S_2$, $S_3$, $S_4$, $S_5$, $S_n$. Alternatively, associations between noise affecting factors and respective sensor indications from sensors $S_1$, $S_2$, $S_3$, $S_4$, $S_5$, $S_n$, may be predetermined such as, by way of example and not by way of limitation, during one or more test flights or other test operations. The predetermined factors may be stored in memory unit 16 to form a noise profile data base 30. By way of example and not by way of limitation, a sensor $S_1$ may sense altitude in feet and altitude may be indicated by a factor $f_1$. A sensor $S_2$ may sense airspeed as a mach number and airspeed may be indicated by a factor $f_2$. A sensor $S_3$ may sense weight on wheels (WOW) as an indication whether the aircraft is operating on the ground or is aloft and WOW may be indicated by a factor $f_3$. A sensor $S_4$ may sense status of the aircraft passenger access door as being open or closed and door status may be indicated by a factor $f_4$. A sensor $S_5$ may sense engine data such as revolutions per minute (RPM) or pounds of thrust and engine data may be indicated by a factor $f_5$. A sensor $S_6$ may sense flap position in terms of whether the flaps are up or down and by how many degrees and flap position may be indicated by a factor $f_6$. A sensor $S_7$ may sense spoiler position in terms of whether the spoilers are deployed or not deployed and spoiler position may be indicated by a factor $f_7$. A sensor $S_8$ may wind speed in terms of miles per hour (MPH) and MPH may be indicated by a factor $f_8$. A sensor $S_9$ may sense status of the aircraft ECS (Environmental Control System) in terms of whether the ECS is heating or cooling the passenger compartment and ECS status may be indicated by a factor $f_9$. A sensor $S_{10}$ may sense status of the aircraft APU (Auxiliary Power Unit) in terms of revolutions per minute (RPM) and APU RPM may be indicated by a factor $f_{10}$. A sensor $S_{11}$ may sense noise frequencies present in the passenger compartment or elsewhere in or around the aircraft in terms of Hertz (Hz) and noise frequencies may be indicated by a factor $f_{11}$. A sensor $S_{12}$ may sense noise levels present in the passenger compartment or elsewhere in or around the aircraft in terms of decibels (dB) and noise levels may be indicated by a factor $f_{12}$. Microprocessor unit 22 may employ some or all of factors $f_1$-$f_{12}$ in a noise compensation—cancellation unit 26 to present an output signal at an output locus 28 for use by an address system (not shown in FIG. 1) to effect countering ambient noise in a compartment of a passenger transport unit, such as a passenger aircraft. Memory unit 16 may be configured integrally within noise handling system 12, or memory unit 16 may be configured as a unit separate from noise handling system 12, as shown in FIG. 1.

Sensors $S_1$, $S_2$, $S_3$, $S_4$, $S_5$, $S_n$ are indicated in FIG. 1 in dotted line format to represent that sensors $S_1$, $S_2$, $S_3$, $S_4$, $S_5$, $S_n$ may be employed during flight testing or similar pre-operational evolutions to collect data for creation of noise profile database 30 to store indications relating with airplane compartment noise at levels at different modes of operations such as, by way of example and not by way of limitation, factors $f_1$-$f_{12}$. Data for populating noise profile database 30 may be collected during flight tests, analyzed and refined to fit the flight patterns of each respective aircraft model. Noise compensation-cancellation unit 26 may use noise profile database 30 to define ambient noise parameters for each flight mode. Noise cancellation unit 26 may employ factors $f_1$-$f_{12}$ to effect noise cancellation using any method known by those skilled in the art of compensating or countering ambient noise.

If system 10 is to be used for countering ambient noise in a plurality of passenger compartments, factors $f_1$-$f_{12}$ may vary among respective compartments of the plurality of compartments for each indicator sensed by sensors $S_1$, $S_2$, $S_3$, $S_4$, $S_5$, $S_n$ as the effect of a particular indicator may differently impact a particular respective compartment.

System 10 may also include a plurality of passenger address audio sources $A_1$, $A_2$, $A_m$ relating to passenger address units or systems. The indicator "m" is employed to signify that there can be any number of audio sensors included in system 10. The inclusion of three audio sources $A_1$, $A_2$, $A_m$ in FIG. 1 is illustrative only and does not constitute any limitation regarding the number of audio sensors that may be included in the system of the present disclosure.

Passenger address audio sources $A_1$, $A_2$, $A_m$ may be coupled with an audio compensating system 40 included within noise handling system 12. Audio compensating system 40 may include an audio priority switching unit 42, an anti-aliasing low pass filter unit 44 and an audio-to-digital converter unit 46. Audio priority switching unit 42 may receive indications of passenger address audio signals from audio sources $A_1$, $A_2$, $A_m$ and may affect the amount of influence received audio signals may have upon operation of system 10. Audio priority switching unit 42 may be coupled with anti-aliasing low pass filter unit 44 for treating sampling of signals provided from audio priority switching unit 42. Anti-aliasing low pass filter unit 44 may be coupled with audio-to-digital converter unit 46 for converting audio signals received from anti-aliasing low pass filter unit 44 to digital signals for use by noise compensation-cancellation unit 26. Audio compensating system 40 may be configured integrally within noise handling system 12 as shown in FIG. 1, or audio compensating system 40 may be configured as a unit separate from noise handling system 12 (not shown in FIG. 1; understood by one skilled in the art of signal handling circuit design).

Sensors $S_1$, $S_2$, $S_3$, $S_4$, $S_5$, $S_n$ may be operational sensors associated with providing information to airplane control unit 14. Operating noise compensation-cancellation unit 26 using factors $f_1$-$f_{12}$ based upon indicators sensed by sensors $S_1$, $S_2$, $S_3$, $S_4$, $S_5$, $S_n$ during test flights or other test operations may permit effecting noise compensation-cancellation without having to provide additional real-time sensors. Indications of passenger address audio signals from audio sources $A_1$, $A_2$, $A_m$ may also be provided without requiring additional sensors. Such audio-related indications may simply represent operational status of an audio source $A_1$, $A_2$, $A_m$ such as, by way of example and not by way of limitation, "ON", "OFF" or "TRANSMITTING". Compensation for audio signals may be based upon predetermined correcting or compensating factors related with such operational statuses. Savings may thus be realized in avoiding additional costs (no additional costs for providing additional sensors) and reduced opportunities for malfunctioning sensors because there may be no additional sensors.

Figure 2:
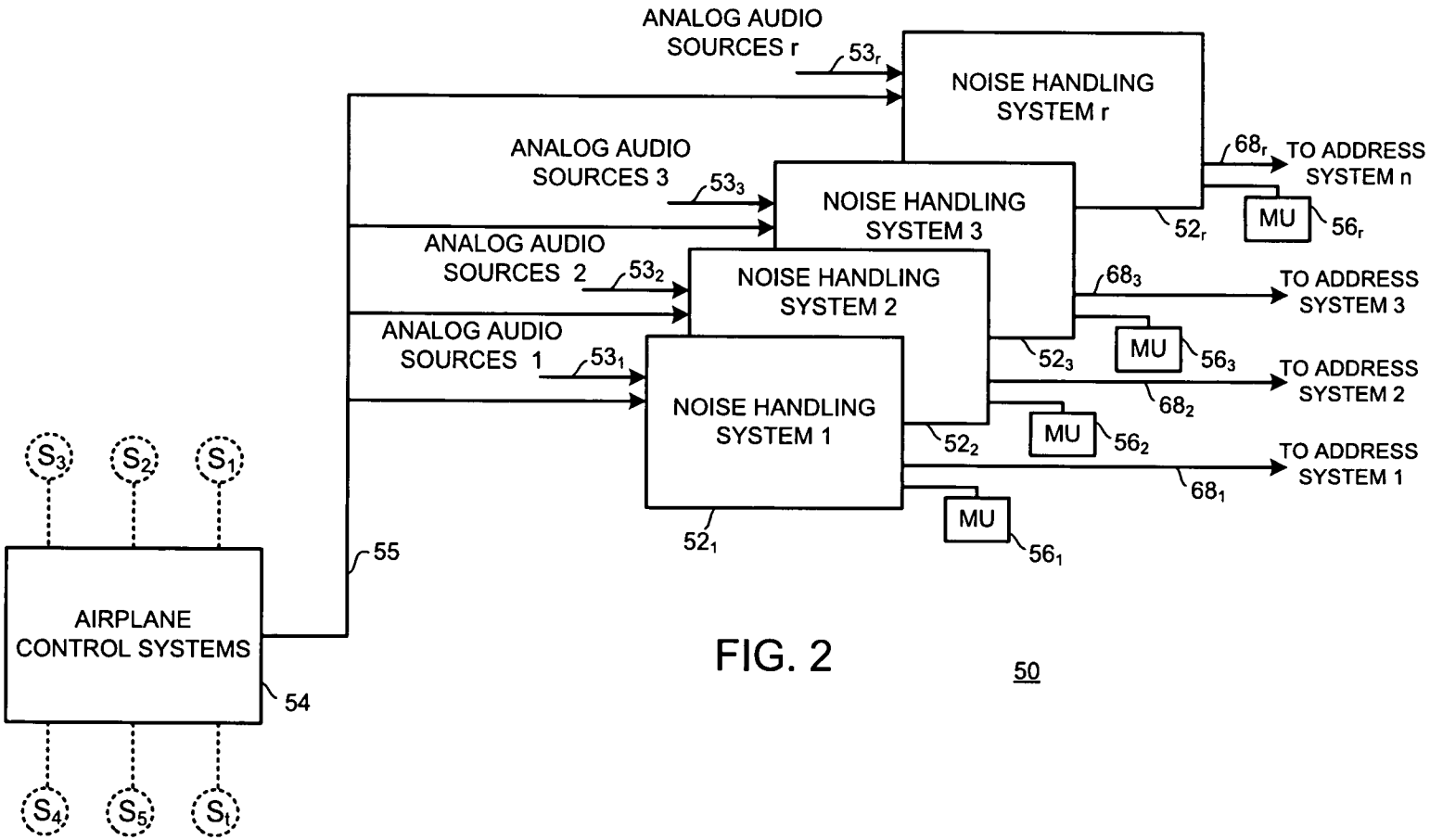
FIG. 2 is a schematic illustration of a system for countering ambient noise when operating an address system in a plurality of compartments in a passenger transport unit.

FIG. 2 is a schematic illustration of a system for countering ambient noise when operating an address system in a plurality of compartments in a passenger transport unit. In FIG. 2, a system 50 for countering noise in a plurality of compartments of a passenger transport unit may include noise handling systems $\mathbf{52}_1$, $\mathbf{52}_2$, $\mathbf{52}_3$, $\mathbf{52}_r$. The indicator "r" is employed to signify that there can be any number of noise handling systems in system 50. The inclusion of four noise handling systems $\mathbf{52}_1$, $\mathbf{52}_2$, $\mathbf{52}_3$, $\mathbf{52}_r$ in FIG. 2 is illustrative only and does not constitute any limitation regarding the number of noise handling systems that may be included in the system of the present disclosure. Noise handling systems $\mathbf{52}_1$, $\mathbf{52}_2$, $\mathbf{52}_3$, $\mathbf{52}_r$ may be coupled with a control unit such as an airplane control unit 54 via an aircraft communication bus 55 or similar communicating connection.

Airplane control unit 54 may be coupled with a plurality of sensors located in various loci about an airplane for presenting an indication representing operation condition of a transportation unit carrying system 50, such as an airplane. Airplane control unit 54 may be coupled with sensors $S_1$, $S_2$, $S_3$, $S_4$, $S_5$, $S_t$. The indicator "t" is employed to signify that there can be any number of sensors coupled with airplane control unit 14. The inclusion of six sensors $S_1$, $S_2$, $S_3$, $S_4$, $S_5$, $S_t$ in FIG. 2 is illustrative only and does not constitute any limitation regarding the number of sensors that may be included in the system of the present disclosure.

Sensors $S_1$, $S_2$, $S_3$, $S_4$, $S_5$, $S_t$ may be used by airplane control unit 54 for other purposes, and may include by way of example and not by way of limitation, indicators described in connection with sensors $S_n$ in FIG. 1.

Each of the sensors $S_1$, $S_2$, $S_3$, $S_4$, $S_5$, $S_t$ may provide information or indications that may be represented in terms of the contribution the sensed indication may make to ambient noise within a compartment of a transport unit, such as an airplane. By way of example and not by way of limitation, different evolutions may present different noise characteristics in a compartment of an aircraft. An airplane may present a first set of noises—in terms of volume levels, frequencies and patterns—while taxiing to a runway in preparation for take off. The same aircraft may present a different second set of noises while taking off. The same aircraft may present a third set of noises while cruising. Characteristics of noises sensed by sensors $S_1$, $S_2$, $S_3$, $S_4$, $S_5$, $S_t$ may be stored in a respective memory or storage unit $\mathbf{56}_1$, $\mathbf{56}_2$, $\mathbf{56}_3$, $\mathbf{56}_r$.

Each noise handling system $\mathbf{52}_r$ may include a receiver unit, a microprocessor unit, a local memory unit and a noise compensation-cancellation unit generally as described in connection with system 10 (FIG. 1). Associations between noise affecting factors and respective sensor indications from sensors $S_1$, $S_2$, $S_3$, $S_4$, $S_5$, $S_t$, may be predetermined and the predetermined factors may be stored in a respective memory unit $\mathbf{56}_1$, $\mathbf{56}_2$, $\mathbf{56}_3$, $\mathbf{56}_r$. Each respective memory unit $\mathbf{56}_1$, $\mathbf{56}_2$, $\mathbf{56}_3$, $\mathbf{56}_r$ may be formed integrally with a respective noise handling system $\mathbf{52}_1$, $\mathbf{52}_2$, $\mathbf{52}_3$, $\mathbf{52}_r$ or may be coupled with a respective noise handling system $\mathbf{52}_1$, $\mathbf{52}_2$, $\mathbf{52}_3$, $\mathbf{52}_r$. Each respective memory unit $\mathbf{56}_1$, $\mathbf{56}_2$, $\mathbf{56}_3$, $\mathbf{56}_r$ may store a respective predetermined noise profile data base (see noise profile data base 30; FIG. 1) for a respective passenger compartment.

Sensors $S_1$, $S_2$, $S_3$, $S_4$, $S_5$, $S_t$ are indicated in FIG. 2 in dotted line format to represent that sensors $S_1$, $S_2$, $S_3$, $S_4$, $S_5$, $S_t$ may be employed during flight testing or similar pre-operational evolutions to collect data for creation of a respective noise profile database in each respective memory unit $\mathbf{56}_1$, $\mathbf{56}_2$, $\mathbf{56}_3$, $\mathbf{56}_r$ to store indications relating with airplane compartment noise at levels at different modes of operations such as, by way of example and not by way of limitation, factors $f_1$-$f_{12}$ (FIG. 1). Data for populating each respective noise profile database in each respective memory unit $\mathbf{56}_1$, $\mathbf{56}_2$, $\mathbf{56}_3$, $\mathbf{56}_r$ may be collected during flight tests, analyzed and refined to fit the flight patterns of each respective aircraft model. Each respective noise handling system $\mathbf{52}_1$, $\mathbf{52}_2$, $\mathbf{52}_3$, $\mathbf{52}_r$ may use a respective noise profile database in a respective memory unit $\mathbf{56}_1$, $\mathbf{56}_2$, $\mathbf{56}_3$, $\mathbf{56}_r$ to define ambient noise parameters for each flight mode.

Microprocessor units in each noise handling system $\mathbf{52}_r$ may employ some or all of the respective factors $f_1$-$f_{12}$ stored in an associated memory unit in a respective noise compensation—cancellation unit (not shown in FIG. 2) to present an output signal at a respective output locus $\mathbf{68}_r$ for use by an address system (not shown in FIG. 2) to effect countering ambient noise in a respective compartment of a passenger transport unit, such as a passenger aircraft.

Factors $f_1$-$f_{12}$ may vary among respective memory units $\mathbf{56}_1$, $\mathbf{56}_2$, $\mathbf{56}_3$, $\mathbf{56}_r$ to provide a respective predetermined noise profile data base (see noise profile data base 30; FIG. 1) for each respective passenger compartment in a passenger transport unit.

System 50 may also include a plurality of-passenger address audio source signals relating to passenger address units or systems provided to audio input loci $\mathbf{53}_1$, $\mathbf{53}_2$, $\mathbf{53}_3$, $\mathbf{53}_r$ of noise handling systems $\mathbf{53}_1$, $\mathbf{53}_2$, $\mathbf{53}_3$, $\mathbf{53}_r$. Audio source signals may be processed by an audio compensating system included within each respective noise handling system $\mathbf{52}_r$ (see audio compensating system 40; FIG. 1) and provided for use by a respective noise compensation-cancellation unit (see noise compensation-cancellation unit 26; FIG. 1) in a respective noise handling system $\mathbf{52}_r$.

Figure 3:
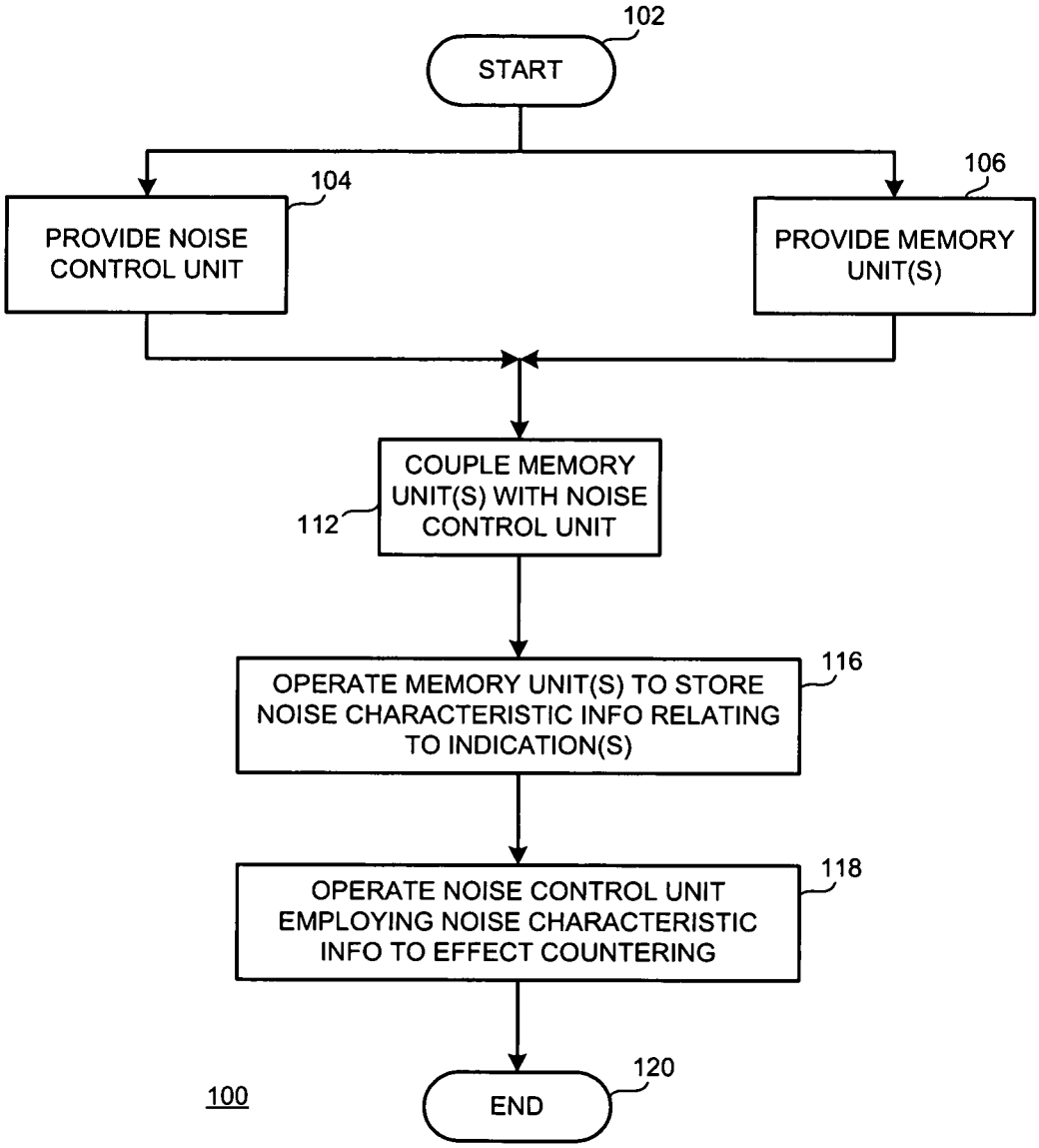
FIG. 3 is a flow diagram illustrating a method for countering ambient noise when operating an address system in a compartment of passenger transport unit.

FIG. 3 is a flow diagram illustrating a method for countering ambient noise when operating an address system in a compartment of passenger transport unit. In FIG. 3, a method 100 for countering ambient noise when operating an address system in at least one compartment of a passenger transport unit may begin at a START locus 102.

Method 100 may continue with, in no particular order: (1) providing a noise control unit, as indicated by a block 104; and (2) providing at least one memory unit, as indicated by a block 106.

Method 100 may continue with, coupling the at least one memory unit with the noise control unit, as indicated by a block 112.

Method 100 may continue with operating the at least one memory unit to store noise characteristic information relating with at least one selected indication of the at least one indication, as indicated by a block 116.

Method 100 may continue with operating the noise control unit employing the noise characteristic information to effect the countering, as indicated by a block 118. Method 100 may terminate at an END locus 120.

Figure 4:
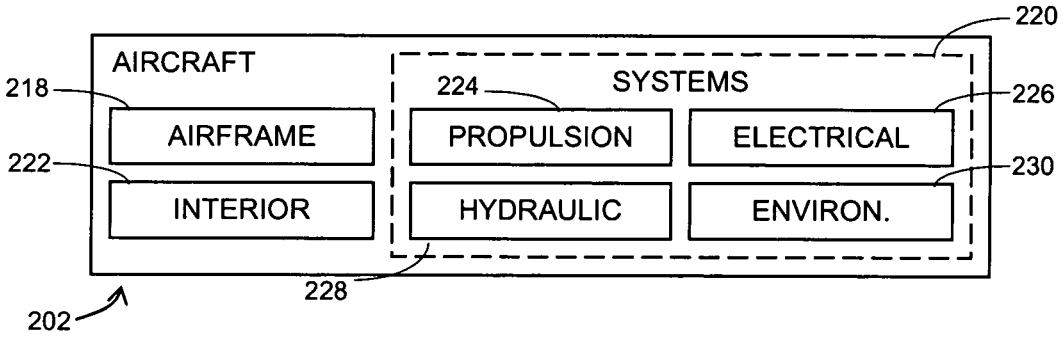
FIG. 4 is a block diagram of an aircraft.

FIG. 4 is a block diagram of an aircraft. In FIG. 4, an aircraft 202 may include an airframe 218 with a plurality of systems 220 and an interior 222. Examples of high-level systems 220 include one or more of a propulsion system 224, an electrical system 226, a hydraulic system 228, and an environmental system 230. Any number of other systems may be included. Although an aerospace example is shown, the principles of the invention may be applied to other industries, such as the automotive industry.

It is to be understood that, while the detailed drawings and specific examples given describe preferred embodiments of the disclosure, they are for the purpose of illustration only, that the system and method of the disclosure are not limited to the precise details and conditions disclosed and that various changes may be made therein without departing from the spirit of the disclosure which is defined by the following claims:

I claim:

1. A system for countering ambient noise when operating an address system in at least one compartment of a passenger transport unit comprising a plurality of operating conditions, the system comprising:

a noise control unit;

an audio sensor, said audio sensor being situated at one locus of said passenger transport unit, said audio sensor capturing audio information from said one locus for each operating condition of said passenger transport unit, wherein each operating condition provides a different level of ambient noise; and at least one memory unit coupled with said noise control unit and said audio sensor, said at least one memory unit storing the captured audio information and a plurality of predetermined factors relating to noise characteristic information relating with the stored captured audio information associated with each operating condition of said passenger transport unit;

said noise control unit employing at least one selected factor of said plurality of factors for a particular operating condition from said plurality of operating conditions to effect said countering of ambient noise during said particular operation condition.

2. A system for countering ambient noise when operating an address system in at least one compartment of a passenger transport unit as recited in claim 1 wherein said at least one compartment is a plurality of compartments; said at least one memory unit storing said plurality of predetermined factors relating with each respective compartment of said plurality of compartments; said countering varying for each respective compartment according to said plurality of predetermined factors relating with said respective compartment.

3. A system for countering ambient noise when operating an address system in at least one compartment of a passenger transport unit as recited in claim 1 wherein said at least one memory unit is coupled with a transport control unit; said transport control unit controlling predetermined operations of said passenger transport unit.

4. A system for countering ambient noise when operating an address system in at least one compartment of a passenger transport unit as recited in claim 3 wherein said transport unit is a passenger aircraft, and wherein said transport control unit is an aircraft control unit.

5. A system for countering ambient noise when operating an address system in at least one compartment of a passenger transport unit as recited in claim 4 wherein said at least one compartment is a plurality of compartments; said at least one memory unit storing said plurality of predetermined factors relating with each respective compartment of said plurality of compartments; said countering varying for each respective compartment according to said plurality of predetermined factors relating with said respective compartment.

6. A system for countering ambient noise when operating an address system in a plurality of compartments of a passenger transport unit comprising a plurality of operating conditions, the system comprising:

a noise control unit;

a plurality of audio sensors, each of said plurality of audio sensors being situated in a respective one of said plurality of compartments of said passenger transport unit, said plurality of audio sensors capturing audio information from said respective plurality of compartments for each operating condition of said passenger transport unit, wherein each operating condition provides a different level of ambient noise for each of said plurality of compartments; and at least one memory unit coupled with said noise control unit and each of said plurality of audio sensors, said at least one memory unit storing the captured audio information and a plurality of predetermined factors relating to noise characteristic information relating with said stored captured audio information from said plurality of audio sensors;

said noise control unit employing at least one factor of said plurality of factors to effect said countering in each respective compartment of said plurality of compartments during a particular operating condition.

7. A system for countering ambient noise when operating an address system in a plurality of compartments of a passenger transport unit as recited in claim 6 wherein said at least one memory unit stores said plurality of predetermined factors relating with each said respective compartment; said countering varying for each said respective compartment according to said plurality of predetermined factors relating with said respective compartment.

8. A system for countering ambient noise when operating an address system in a plurality of compartments of a passenger transport unit as recited in claim 6 wherein said at least one memory unit is coupled with a transport control unit; said transport control unit controlling predetermined operations of said passenger transport unit.

9. A system for countering ambient noise when operating an address system in a plurality of compartments of a passenger transport unit as recited in claim 8 wherein said transport unit is a passenger aircraft, and wherein said transport control unit is an aircraft control unit.

10. A system for countering ambient noise when operating an address system in a plurality of compartments of a passenger transport unit as recited in claim 9 wherein said at least one memory unit stores said noise characteristic information relating with each said respective compartment; said countering varying for each said respective compartment according to said noise characteristic information relating with said respective compartment.

11. A method for countering ambient noise when operating an address system in a plurality of compartments of a passenger transport unit comprising a plurality of operating conditions, the method comprising:

capturing audio information during each operating condition of the passenger transport unit, wherein each operating condition provides a different level of ambient noise;

based on the captured audio information, creating a noise profile for each operating condition, the noise profile comprising ambient noise parameters for each of the plurality of operating conditions;

determining a current operation condition; and transmitting an output signal based on the noise profile for the current operating condition to effect countering ambient noise in a respective compartment during the current operation condition.

12. A method in accordance with claim 11, wherein capturing audio information for each operating condition of the passenger transport unit further comprises capturing audio information from each of the plurality of compartments for each operating condition.

13. A method in accordance with claim 12, wherein each of the plurality of compartments provides a different ambient noise level for each of the plurality of operating conditions.

14. A method in accordance with claim 13, wherein transmitting an output signal based on the noise profile for the current operating condition to effect countering ambient noise in a respective compartment during the current operation condition comprises transmitting a separate output signal to each of the plurality of compartments, each of the separate output signals being based on the noise profile for the current operating condition to effect countering ambient noise in respective compartments.

* * * * *